US010113799B2

(12) United States Patent
Tockert et al.

(10) Patent No.: US 10,113,799 B2
(45) Date of Patent: Oct. 30, 2018

(54) GEARBOX ASSEMBLY FOR A CHARGING INSTALLATION OF A METALLURGICAL REACTOR

(71) Applicant: Paul Wurth S.A., Luxembourg (LU)

(72) Inventors: Paul Tockert, Berbourg (LU); Jeff Vandivinit, Dalheim (LU); René Hientgen, Moestroff (LU)

(73) Assignee: PAUL WURTH S.A., Luxembourg (LU)

( * ) Notice: Subject to any disclaimer, the term of this patent is extended or adjusted under 35 U.S.C. 154(b) by 73 days.

(21) Appl. No.: 15/315,361

(22) PCT Filed: Jun. 4, 2015

(86) PCT No.: PCT/EP2015/062509
§ 371 (c)(1),
(2) Date: Nov. 30, 2016

(87) PCT Pub. No.: WO2015/185693
PCT Pub. Date: Dec. 10, 2015

(65) Prior Publication Data

US 2017/0198972 A1 Jul. 13, 2017

(30) Foreign Application Priority Data

Jun. 6, 2014 (LU) ..... 92469

(51) Int. Cl.
*C21B 7/20* (2006.01)
*F27D 3/10* (2006.01)
(Continued)

(52) U.S. Cl.
CPC ..... *F27D 3/10* (2013.01); *F27B 1/20* (2013.01); *F27D 99/00* (2013.01); *C21B 7/20* (2013.01); *F27D 99/0073* (2013.01)

(58) Field of Classification Search
CPC ..... F27D 3/10; F27B 1/20; F23K 3/00; C21B 7/18; C21B 7/20
(Continued)

(56) References Cited

U.S. PATENT DOCUMENTS 3,152,703 A * 10/1964 Slagley, Jr. ..... C21B 7/18 414/202
3,182,983 A * 5/1965 Tsujihata ..... C21B 7/18 414/202
(Continued)

FOREIGN PATENT DOCUMENTS

FR 2216351 A1 8/1974
WO 2012016902 A1 7/2011

OTHER PUBLICATIONS

International Search Report dated Aug. 3, 2015 re: Application No. PCT/EP2015/062509; pp. 1-3; citing: US 2012/148373 Al and FR 2 216 351 A.
(Continued)

*Primary Examiner* — James R Bidwell
(74) *Attorney, Agent, or Firm* — Cantor Colburn LLP

(57) ABSTRACT

A gearbox assembly for a charging installation of a metallurgical reactor includes a stationary casing housing a gear assembly. The casing includes a bottom section with a central opening. The assembly further includes a rotor mounted within the casing for rotation about a first axis, which defines an axial direction. The rotor includes a support for the gear assembly, wherein a lower section of the support is disposed within the central opening. To provide for a better protection of a gear assembly, the bottom section includes a first annular portion extending radially inwards to a first radius. The lower section has a second annular portion extending radially outwards to a second radius that is greater than the first radius. The second annular portion is disposed
(Continued)

adjacent to the first annular portion. The first annular portion includes a ring element disposed for sliding contact with the second annular portion.

11 Claims, 2 Drawing Sheets

(51) Int. Cl.
*F27B 1/20* (2006.01)
*F27D 99/00* (2010.01)

(58) Field of Classification Search
USPC ..... 414/194, 199, 202, 804
See application file for complete search history.

(56) References Cited

U.S. PATENT DOCUMENTS

| | | | | |
|---|---|---|---|---|
| 3,651,964 | A * | 3/1972 | Nieboer | C21B 7/18 414/202 |
| 3,679,193 | A * | 7/1972 | Nieboer | C21B 7/18 414/202 |
| 3,972,426 | A * | 8/1976 | Tachiyama | C21B 7/20 414/194 |
| 8,419,336 | B2 * | 4/2013 | Fletcher | C21B 7/20 414/207 |
| 2012/0148373 | A1 | 6/2012 | Howell et al. | |

OTHER PUBLICATIONS

Written Opinion dated Aug. 3, 2015 re: Application No. PCT/EP2015/062509; pp. 1-6; citing: US 2012/148373 A1 and FR 2 216 351 A.

* cited by examiner

GEARBOX ASSEMBLY FOR A CHARGING INSTALLATION OF A METALLURGICAL REACTOR

TECHNICAL FIELD

The invention relates to a gearbox assembly of a charging installation of a metallurgical reactor. It further relates to a charging installation of a metallurgical reactor.

BACKGROUND ART

Metallurgical reactors are well known in the art. These reactors are typically gravity-fed from above by a charging installation, which in turn may be fed with bulk material from intermediate hoppers. One type of charging installation is disclosed in international application WO 2012/016902 A1. Here, the material is fed through a feeder spout, which is positioned above the inlet of a distribution chute. The chute is mounted on a rotatable support, in which the feeder spout is disposed. To provide for a two-dimensional mobility of the chute, it is also tiltable relative to the support by shafts connected to a gear assembly. The gear assembly is positioned inside a gearbox formed by the support and a stationary casing on which the support is rotationally mounted. For protection of the gear assembly, the bottom portion of the casing has a heat protection shield with a cooling circuit. The shield defines a central opening, in which a lower portion of the support is disposed. Although the overall design of this device is effective and provides for adequate protection of the gear assembly, heat and dust from the reactor may enter into the gearbox, especially when the casing and/or the support are deformed.

BRIEF SUMMARY

The disclosure provides for a better protection of a gear assembly. More specifically, a gearbox assembly and a charging installation are provided herein.

The disclosure provides a gearbox assembly for a charging installation of a metallurgical reactor. The metallurgical reactor may in particular be of the blast furnace type. A charging installation will usually be of the type where the bulk material is gravity-fed to the reactor. Therefore, in these cases, the charging installation is—at least for the larger part—intended to be installed above the reactor. The inventive assembly comprises a stationary casing for housing a gear assembly, the casing comprising a bottom section with a central opening. The term "stationary" of course refers to the state when the charging installation is mounted to the reactor. The "bottom" side is the side of the gearbox assembly, which faces the reactor, which is, in a gravity-feeding system, the lower side. Typically, the casing is designed to protect the gear assembly from above, below and laterally from one side. Of course, the casing may comprise access doors for maintenance and mounting or dismounting of the gear assembly. It is understood that, since the bottom section faces the reactor, it may comprise heat protection elements like a refractory layer and/or a cooling circuit. Alternatively, such heat protection elements may be mounted below the bottom section.

The gearbox assembly further comprises a rotor mounted within the casing for rotation about a first axis, which defines an axial direction, the rotor comprising a support for the gear assembly, a lower section of the support being disposed within the central opening. The support may in particular be cylindrical, but may also include a shape that tapers along a symmetry axis. Usually, the support is symmetrical with respect to the first axis and has a circular cross-section. However, the cross-section may also be e.g. polygonal (with a high number of corners) as long as this does not hinder rotation within the casing. The casing, of course, has a recess in which the support is received. The support may to some extent protrude downwards through the central opening, but usually its lower end is within the opening.

The configuration of the elements described so far essentially corresponds, e.g., to the embodiment shown in WO 2012/016902 A1.

The bottom section comprises a first annular portion extending radially inwards to a first radius and the lower section has a second annular portion extending radially outwards to a second radius that is greater than the first radius. "Radially" herein refers to the coordinate system defined by the axial direction. The relation of the two radiuses means that the two annular sections overlap in the axial direction. Herein, the second annular portion is disposed adjacent to the first annular portion. "Adjacent" in this context means that a distance between the two annular portions is very small, at least compared to the dimensions of the gearbox assembly. As will be explained later, the two annular portions may be contacting each other. In any case, the overlap of the two portions means that a direct path along the axial direction from below the gearbox assembly into its interior is blocked. In other words, hot gases and/or dust will have to go a longer way to get into the gearbox assembly, if at all. Of course, to allow for unhindered rotation around the first axis said first and second annular portion have a rotational symmetry with respect to said first axis.

To allow for a better sealing against hot gases and dust, it is preferred that the second annular portion is disposed for sliding contact with the first annular portion. This means that the dimensions of the casing and the support and their position relative to each other are chosen such that the two annular portions contact each other, so that the second annular portion can slide along the first annular portion during rotation of the rotor.

In a preferred embodiment, the first annular portion is disposed axially above the second annular portion. In other words, the first annular portion is further away from the reactor side of the gearbox assembly. Here and in the following, terms like "above", "below", "upward", "downward" etc. refer to the axial direction, where the bottom section of the casing is on its "lower" side.

An interesting feature is that the furnace pressure acts on the second annular portion and pushes the latter toward the first annular portion. Consequently, as the pressure in the metallurgical reactor increases, so does the contact pressure between the first and second annular portion. Thus, the seal becomes more effective as the reactor pressure increases. The metallurgical reactor pressure is actually used to seal the gearbox assembly.

In the abovementioned embodiment, it is particularly preferred that the first annular portion comprises a downward projecting portion. The presence of this downward projecting portion means that the possible path into the interior of the gearbox would lead upwards to get past the second annular portion, then radially inwards and possibly downwards to get past the downward projecting portion and finally upwards again. In this case, the path is considerably longer and more complicated, so that the interior of the gearbox assembly is effectively protected. In particular, the downward projecting portion may be contacting the second annular portion from above.

The first annular portion comprises a ring element disposed for sliding contact with the second annular portion. Such a ring element is usually manufactured separately and afterwards mounted to the bottom portion of the casing. The material of the ring element may be chosen to be optimal for the sliding contact. Since the ring element may be subjected to at least moderately elevated temperatures from the reactor, the material should be chosen to resist such temperatures. It is particularly preferred that the ring element of the first annular portion is at least partially made of brass. This material has particularly good sliding properties. Of course, different materials may be combined in the ring element. Alternatively or additionally, the second annular portion may comprise a ring element, which is preferably made of a hard metal or ceramic material.

In some embodiments the ring element is at least indirectly connected to a bottom plate of the casing. Such a bottom plate is of course located in the bottom region of the casing and usually extends along a plane perpendicular to the first axis. The bottom plate may be made of metal, for example steel. The bottom plate may also consist of individual elements that are connected by welding or other techniques known in the art.

In this context it is advantageous if the ring element is connected to the bottom plate via an intermediate plate. This intermediate plate may be detachably mounted to the bottom plate and/or the ring element. This makes it easier to disconnect the ring element from the bottom plate if necessary for maintenance or replacement.

It is highly preferred that a lubricant is disposed between the first and second annular portion. In this case, the two annular portions are also considered to be in contact with each other if the contact is established by a layer of lubricant. It is preferred that the lubricant is semi-liquid or paste-like, at least at room temperature. The function of the lubricant, which in particular may be grease, is on the one hand to reduce the friction between the two portions, on the other hand to at least partially enhance the sealing properties. Where a lubricant layer exists between the two portions, no dust or hot gases can pass through. Of course, dust may to some extent be bound by the lubricant.

To provide for a better containment and/or spreading of the lubricant, it is preferred that the first annular portion has at least one channel for the lubricant. Such a channel usually is disposed on the surface of the first annular portion which contacts the second annular portion. If the ring member is employed as mentioned above, the channel is disposed on the ring member.

Preferably, the gearbox assembly has at least one supply pipe connected to said at least one channel. This greatly facilitates supply of the lubricant during operation of the charging installation. Such a supply pipe may in particular run essentially in a radial direction. Of course, a plurality of supply pipes may be employed which contact the channel on different locations.

In a preferred embodiment, the second annular portion is delimited on a radially outward side by an upwards extending nose section. On the one hand, such a nose section may further increase the length of the path for hot gases and/or dust and thus enhance the "labyrinth" effect. On the other hand, if the lubricant is disposed on the upper side of the second annular portion, such a nose section may prevent unnecessary lubricant loss. Due to the proximity of the reactor, the annular portions may be subjected to elevated temperatures, under which lubricants that are highly viscous or paste-like at room temperature become fluid. Such a nose section is typically disposed on a radially outwards extending part of the second annular portion. Thus, the lubricant is contained on an outward side by the nose section and usually on an inward side by a vertically extending wall of the support.

A charging installation for a metallurgical reactor is further provided. The charging installation comprises a gearbox assembly as described above and a gear assembly mounted to the support and disposed within the casing. Thus, the gear assembly is part of the rotor and rotates with the support. Although the casing and the support are herein defined as parts of a gearbox assembly, the gear assembly within the casing may comprise additional casing components which may also be considered as part of a gearbox.

Furthermore, the charging installation comprises a chute mounted to the support and connected to the gear assembly via a tilting shaft for tilting about a second axis, an upper inlet of the chute disposed to be fed via a feeder spout disposed within the support. The configuration of the chute and the feeder spout essentially corresponds to the embodiment shown in WO 2012/016902 A1. The feeder spout typically extends through an upper opening of the casing downwards into the support. Bulk material is fed into the feeder spout and due to gravity falls down wards into the upper inlet of the chute. The chute then guides the material to a location which can be specified by the rotational position of the support and the tilting position of the chute itself. It is understood that the charging installation may comprise additional components, for example a cooling hood placed around the feeder spout, a cooling circuit and/or refractory layer protecting the bottom section of the casing etc.

BRIEF DESCRIPTION OF THE DRAWINGS

Details of the invention will now be described with reference to the drawings, wherein.

DESCRIPTION OF PREFERRED EMBODIMENTS

Figure 1:
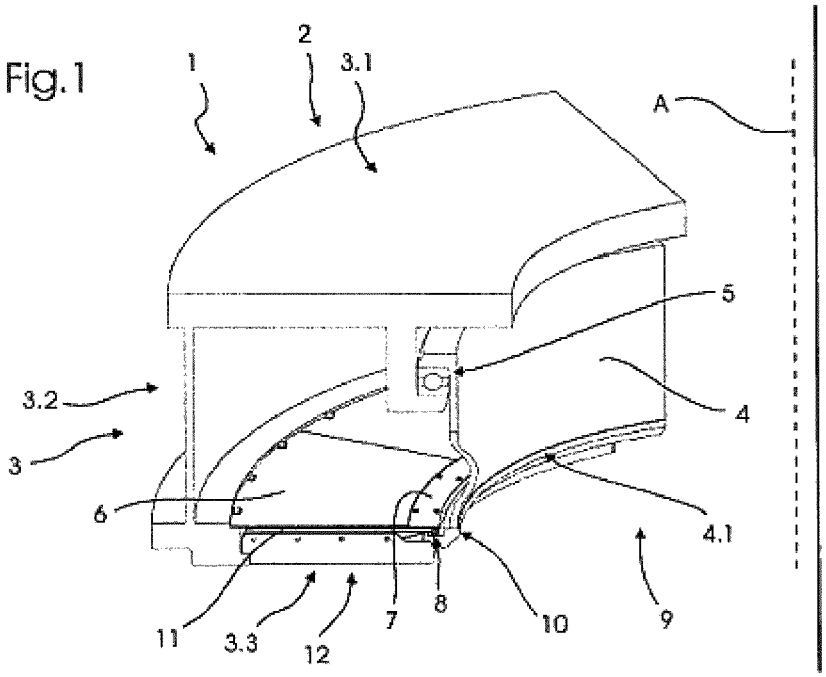
FIG. 1 is a cross-sectional perspective view of a part of a charging installation.

FIG. 1 shows a part of a charging installation 1 for a metallurgical reactor. The charging installation 1 comprises a gearbox assembly 2, which is largely symmetrical to a vertical axis A. It is understood that FIG. 1 only shows an arc-like section of about 60° of the whole assembly 2, which as a whole is more or less annular. The gearbox assembly 2 comprises a stationary casing 3 for housing a gear assembly (not shown). The casing 3 comprises a top section 3.1, a lateral section 3.2 and a bottom section 3.3. In the embodiment depicted, the top section 3.1 and the lateral section 3.2 are formed as one piece and the bottom section 3.3 is mounted to them. However, other configurations are possible. The overall shape of the casing 3 is annular and the shape of the lateral section 3.2 is cylindrical. The bottom section 3.3 comprises a bottom plate 6 which is essentially disposed perpendicular to the axis A. Radially inwards of the bottom plate 6 is an intermediate plate 7, which also essentially extends perpendicular to the axis A. On a radially innermost part of the intermediate plate 7, a brass ring 8 is fixed to its underside. Both plates 6, 7 consist of arc-like segments, although they could also be formed as one piece.

The intermediate plate 7 is mounted to the bottom plate 6 and the ring 8 by bolts to allow for an easy dismantling. The bottom section 3.3, which defines a central opening 9 is facing the reactor (not shown) in operational state. Below the bottom plate 6 is installed a lower heat shield 12, which comprises a cooling system and a refractory layer, which will not be depicted in detail herein.

A cylindrical support 4 for the gear assembly is mounted on the casing 3 by means of a roller bearing 5, which is disposed near the top section 3.1. A lower section 4.1 of the support 4 is disposed within the opening 9. In this lower section 4.1, the support 4 comprises a flange member 10 with a flange section 10.1, which extends radially outward. The flange member 10 is made of abrasion resistant material, such as e.g. steel. As can be seen from FIG. 1 and the enlarged view in FIG. 2, the flange section 10.1 radially extends to a radius that is greater than an inner radius of the intermediate plate 7 and the ring 8. Therefore, these elements 7, 8, 10 overlap in the axial direction. Furthermore, the ring 8 extends downwards from the intermediate plate 7. Thus, even if the ring 8 is not in contact with the flange member 10, the path from the underside of the gearbox assembly 2 to its interior is complicated and long, whence dust and/or hot gases cannot get easily inside.

Figure 2:
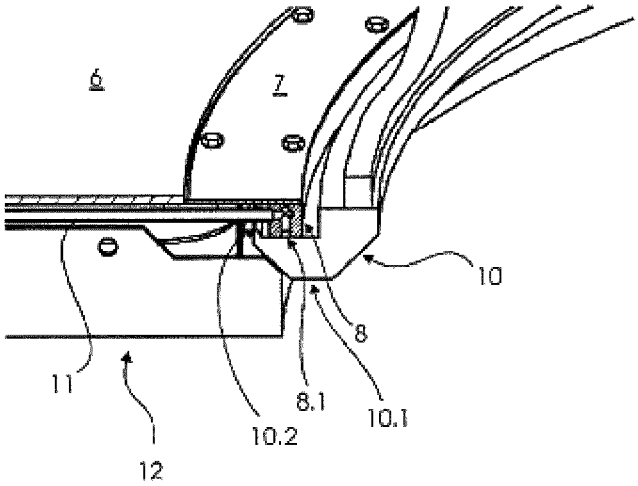
FIG. 2 is an enlarged view of the detail of the charging installation of FIG. 1.

This effect is largely improved by the fact that grease (not shown) is disposed between the ring 8 and the flange section 10.1, whereby these elements 8, 10.1 are in sliding contact with each other. The grease, on the one hand, serves as a lubricant; on the other hand, it functions as a sealing media. The grease is supplied via a plurality of supply pipes 11, one of which is shown in FIGS. 1 and 2. Each supply pipe 11 is connected to a channel 8.1 (see FIG. 2), which runs annularly around the ring 8. The function of the channel 8.1 is to supply the grease to the contact surface between ring 8 and flange section 10.1 of the flange member 10 and also to distribute it circumferentially. While the grease is paste-like at room temperature, it becomes liquid and rather thin at elevated temperatures, which may occur during the operation of the metallurgical reactor. Such elevated temperatures would, under normal operating conditions, be up to about 200° C. To prevent the liquefied grease from flowing radially outwards and being lost, the flange member 10 comprises, on the radially outermost part of the flange section 10.1, an upwards-facing nose section 10.2, which forms a confinement.

Figure 3:
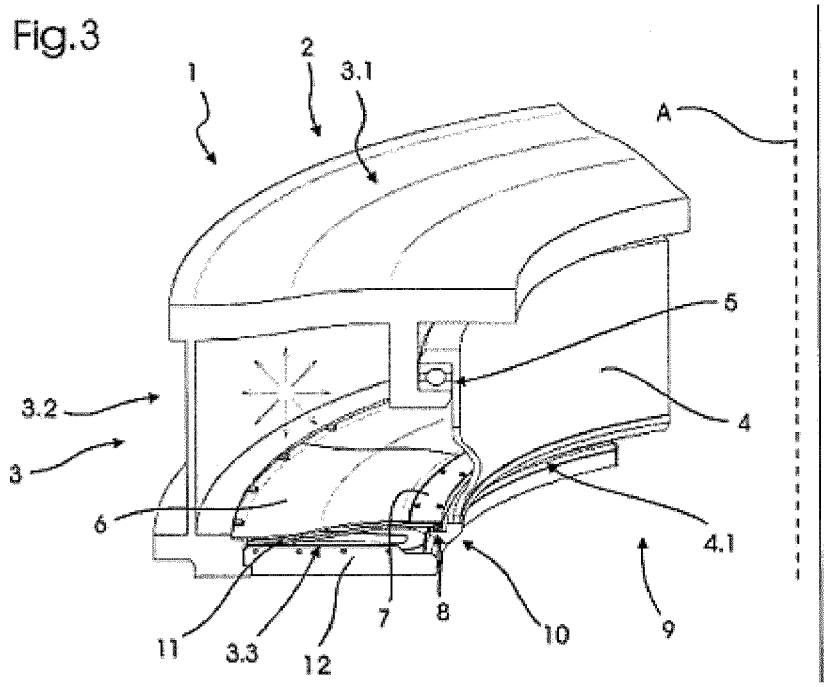
FIG. 3 is a cross-sectional perspective view of the part of the charging installation of FIG. 1 in a deformed state.

While FIG. 1 shows the components of the gearbox assembly 2 at normal working pressure, FIG. 3 shows a deformed state under elevated pressure. The metallurgical reactor pressure, which in particular affects the radially inner parts of the assembly 2, leads to an elevation of the inner parts of the top section 3.1 relative to the outer parts. Therefore, the bearing 5 and the support 4 are lifted. However, since the flange section 10.1 of the flange member 10, which is part of the support 4, is disposed under the ring 8, the lifting does not lead to a disconnection of the flange member 10 from the ring 8. On the contrary, these two parts 8, 10 are pressed together even more tightly. I.e. the sealing effect becomes greater as the temperature rises. As can be seen from FIG. 3 the, bottom plate 6 is also deformed as the intermediate plate 7 and the ring 8 are lifted by the flange member 10. The supply pipe 11 is flexible enough to stay in contact with the channel 8.1, whence grease may be supplied even under elevated temperatures.

It is understood that the deformation of the gearbox assembly 2 is shown in FIG. 3 in an exaggerated way. However, since the sealing effect of the flange member 10 and the ring 8 is largely improved when these elements 8, 10 are in sliding contact with each other, it is a considerable advantage that the deformations even serve to improve the connection.

The invention claimed is:

1. Gearbox assembly for a charging installation of a metallurgical reactor, the assembly comprising:

a stationary casing for housing a gear assembly, the casing comprising a bottom section with a central opening, a rotor mounted within the casing for rotation about a first axis, which defines an axial direction, the rotor comprising a support for the gear assembly, a lower section of the support being disposed within the central opening, wherein the bottom section comprises a first annular portion extending radially inwards to a first radius, and the lower section has a second annular portion extending radially outwards to a second radius that is greater than the first radius, said second annular portion being disposed adjacent to said first annular portion, and wherein the first annular portion comprises a ring element disposed for sliding contact with the second annular portion.

2. Gearbox assembly according to claim 1, wherein the second annular portion is disposed for sliding contact with the first annular portion.

3. Gearbox assembly according to claim 1, wherein the first annular portion is disposed axially above the second annular portion.

4. Gearbox assembly according to claim 3, wherein the first annular portion comprises a downward projecting portion.

5. Gearbox assembly according to claim 1, wherein the ring element is at least partially made of brass.

6. Gearbox assembly according to claim 1, wherein the ring element is at least indirectly connected to a bottom plate of the casing.

7. Gearbox assembly according to claim 6, wherein the ring element is connected to the bottom plate via an intermediate plate.

8. Gearbox assembly according to claim 1, wherein a lubricant is disposed between the first annular portion and the second annular portion.

9. Gearbox assembly according to claim 8, wherein the first annular portion has at least one channel for the lubricant.

10. Gearbox assembly according to claim 9, wherein at least one supply pipe connected to said at least one channel.

11. Gearbox assembly according to claim 3, wherein the second annular portion is delimited on a radially outward side by an upwards extending nose section.

* * * * *